US007828062B2

(12) United States Patent
Budney

(10) Patent No.: US 7,828,062 B2
(45) Date of Patent: Nov. 9, 2010

(54) DOWNHOLE TOOL

(76) Inventor: David L. Budney, 4604 Eleniak Road, Edmonton, Alberta (CA) T6B 2S1

( * ) Notice: Subject to any disclaimer, the term of this patent is extended or adjusted under 35 U.S.C. 154(b) by 12 days.

(21) Appl. No.: 12/016,772

(22) Filed: Jan. 18, 2008

(65) Prior Publication Data

US 2009/0183878 A1 Jul. 23, 2009

(51) Int. Cl.
*E21B 31/00* (2006.01)

(52) U.S. Cl. ..... 166/301; 166/98; 166/99

(58) Field of Classification Search ..... 166/98, 166/99, 301; 294/86.1, 86.12, 86.34
See application file for complete search history.

(56) References Cited

U.S. PATENT DOCUMENTS 1,793,105 A * 2/1931 Lidderdale ..... 294/86.1
2,304,793 A * 12/1942 Bodine, Jr. ..... 166/298
6,758,267 B1 * 7/2004 Sollesnes ..... 166/98
6,805,197 B2 * 10/2004 Brumley et al. ..... 166/298
2005/0006102 A1 1/2005 Cho

OTHER PUBLICATIONS

Bowen Tools Inc Catalog, 3 pages (pp. 3,12, 13) Bowen Tools 1990, USA.

Instruction Manual Bowen "Itcoloy" and Milling Tools, 4 pages (index and pp. 3,4,6) Bowen Tools, Oct. 1979.

* cited by examiner

*Primary Examiner*—William P Neuder

(57) ABSTRACT

An extension sub for a downhole fishing tool, the extension sub comprising a tubular having a threaded pin end and a threaded box end, the tubular having an interior wall defining a bore, and cutting elements fixed to the interior wall of the tubular and extending into the bore of the tubular. Such a device may be referred to as a string shoe.

17 Claims, 3 Drawing Sheets

DOWNHOLE TOOL

BACKGROUND OF THE INVENTION

This invention relates to downhole tools used in fishing operations. Milling shoes, sometimes known as rotary shoes, are used in fishing operations to cut away metal, formation or cement to release a tool that is stuck in a wellbore. The typical milling shoe is a fairly short tubular that is threaded at one end and has cutting material on the side of the shoe at the other end. These milling shoes are useful in removing stuck downhole tools during fishing operations.

During fishing operations to recover stuck or broken members from the well bore using coil tubing or conventional jointed tubing pipe it is sometimes necessary to cut over the fish using a milling shoe at the bottom of the fishing string and let it feed upwards into a larger pipe called a wash-pipe. But the fish will not feed upwards into the wash-pipe very far past the milling shoe at the bottom especially when cutting over broken off coil tubing because the broken off coil tubing keeps breaking off and jamming in the wash-pipe above the milling shoe such that the inventor has found that it becomes impossible to mill any further after the jam occurs.

There exists a Bowen mill extension with a tapered throat faced with Itcoloy™ for milling away a flared or jagged fish to enable the fish to pass up into and be engaged by a grapple in a bowl above the mill extension. However, the Bowen mill extension does not solve the problem of jammed coil tubing because the tapered throat restricts the bore. In addition, the Bowen mill extension requires a grapple and bowl above the mill extension.

SUMMARY OF THE INVENTION

The inventor proposes a solution to this problem that he has identified. Therefore, according to an aspect of the invention there is provided an extension sub for a downhole fishing tool, the extension sub comprising a tubular having a threaded pin end and a threaded box end, the tubular having an interior wall defining a bore, and cutting elements fixed to the interior wall of the tubular and extending into the bore of the tubular. Such a device may be referred to as a string shoe. The string shoe preferably has a straight bore, and may be used in conjunction with additional string shoes.

In various further aspects of the invention, the cutting elements may be buttons, which may be in rows, for example slanted rows, welded into the interior wall or into slots in the interior wall.

In a further aspect of the invention, there is provided a method of fishing for a stuck or broken fish in a well, where the stuck or broken fish includes broken off coil tubing, the method comprising the steps of lowering a well string into the well with the well string terminated with a milling shoe and a string shoe, milling the fish with the milling shoe; while milling the fish the milling shoe, milling the broken off coil tubing with the extension sub; and removing the fish from the well.

These and other aspects of the invention are set out in the claims, which are incorporated here by reference.

BRIEF DESCRIPTION OF THE FIGURES

Preferred embodiments of the invention will now be described with reference to the figures, in which like reference characters denote like elements, by way of example, and in which.

DETAILED DESCRIPTION OF PREFERRED EMBODIMENTS

In the claims, the word "comprising" is used in its inclusive sense and does not exclude other elements being present. The indefinite article "a" before a claim feature does not exclude more than one of the feature being present.

Figure 1:
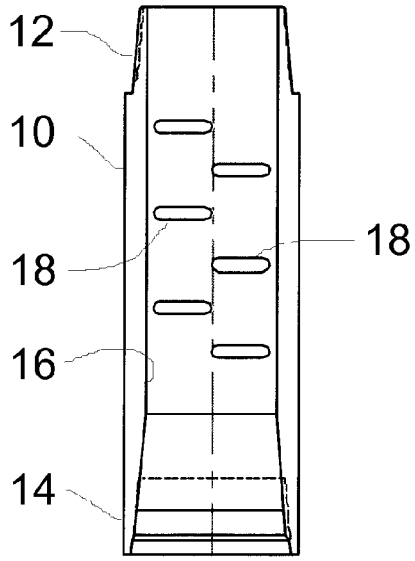
FIGS. 1-7 illustrate various embodiments of the invention.
Figure 9:
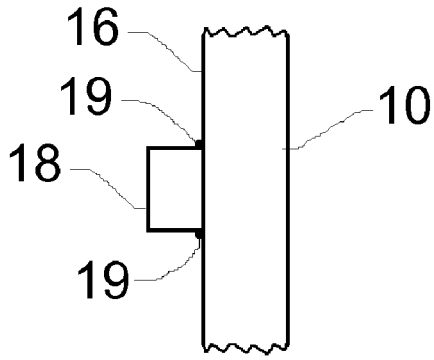
FIG. 9 is a section through a tubular and cutting element of an extension sub according to the invention.

As shown in FIG. 1, an extension sub for a downhole fishing tool is formed from a tubular 10 having a threaded pin end 12 and a threaded box end 14. The tubular 10 has an interior wall 16 defining a bore. Cutting elements 18 are fixed to the interior wall 16 of the tubular 10 and extend into the bore of the tubular 10 such that the cutting elements 18 are raised above the surface of the interior wall 16 to enable the cutting elements 18 to cut material that is inserted into the bore of the tubular 10. FIG. 9 shows a cutting element 18 fixed to the interior wall 16 with welds 19. The cutting elements 18 are preferably distributed completely around the interior wall 16 to provide cutting around the inner circumference of the tubular 10. However, the cutting elements 18 may be distributed over only a portion of the interior wall 16. The bore of the tubular 10 is straight, although minor deviations from exactly straight are permitted and still fall within the meaning of the word straight, providing any deviation from straight is not sufficient to impede the movement of coiled tubing into the extension sub during fishing. The extension sub 10 is typically in the order of 50 cm to 1 meter long.

Figure 2:
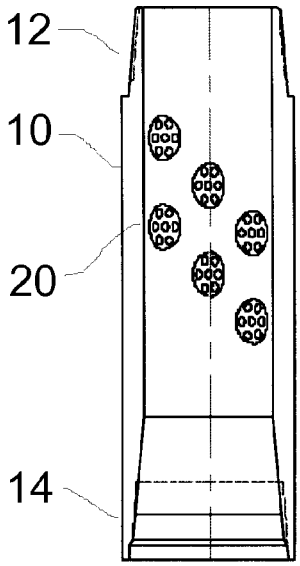
Figure 3:
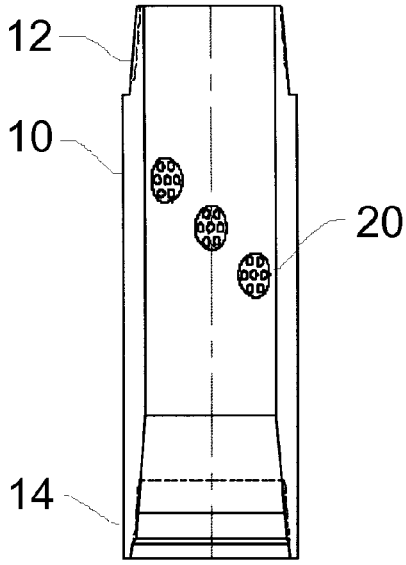
Figure 4:
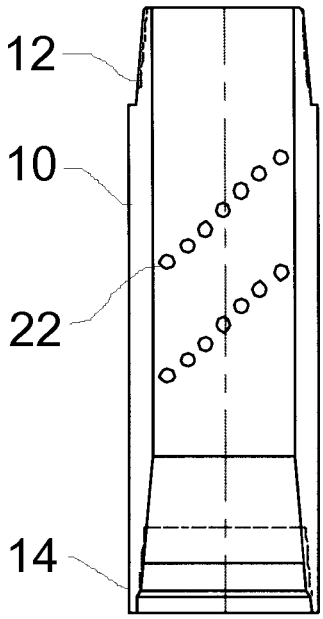
Figure 5:
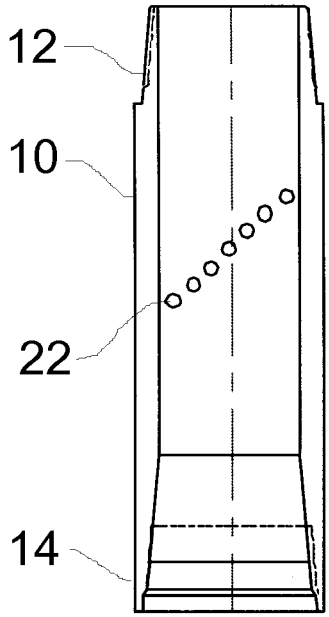
Figure 6:
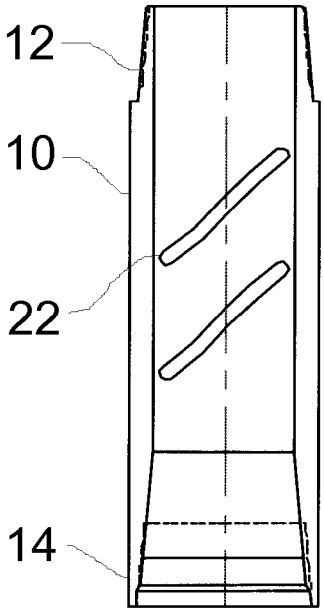
Figure 7:
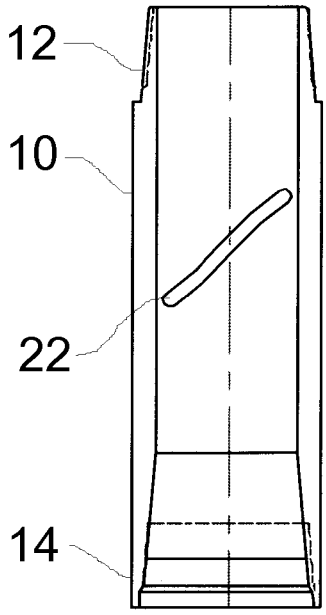

The cutting elements 18 may comprise tungsten carbide buttons in any suitable pattern, such as random (not shown), one row (FIGS. 3, 5 and 7) or two rows (FIGS. 2, 4 and 6, with the rows being slanted to form a right-handed or left handed helical screw pattern on the interior wall 16, and may be welded directly onto the surface of the interior wall 16, or welded into slots cut in the tubular 10. The cutting elements 18 may have any shape, such as round or elongated, and may be made of any material suitable for downhole milling operations. The cutting elements 18 may be a solid or layered body, or may have surface treatment to enhance cutting ability and durability. The cutting elements 18 may for example be buttons 20 as shown in FIGS. 2 and 3, which buttons 20 are round and have shaped faces, round buttons 22 as shown in FIGS. 4 and 5, or elongate buttons 24 as shown in FIGS. 6 and 7. In general, the cutting element may be any downhole cutting element now known or hereafter developed that may be fixed to the interior wall 16 and used to cut metal parts that intrude into the bore of the tubular 10.

Figure 8:
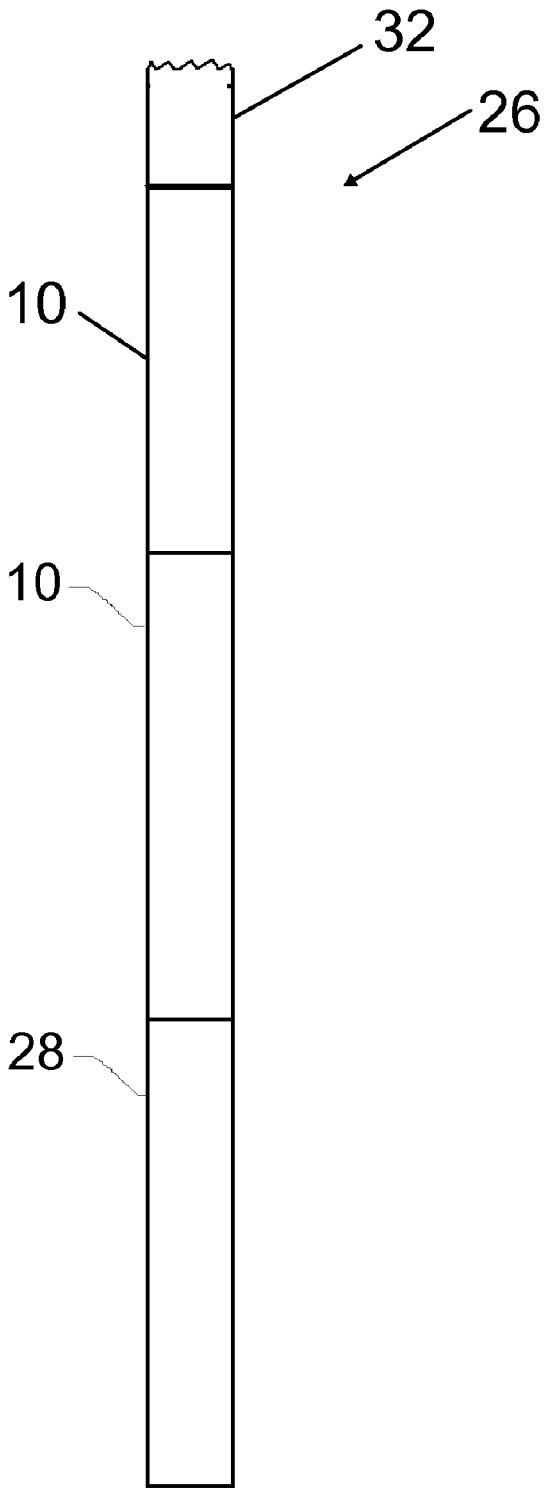
FIG. 8 shows an extension sub according to the invention in a drill string.

The extension sub is used during fishing operations when it is desired to mill a stuck tool so that it may be fished from the hole. As shown in FIG. 8, the extension sub 10 is inserted into a well string 26 comprising plural tubulars 32 above a milling shoe 28 and used to mill metal or other material, such as coiled tubing, that is pressed into the string above the milling shoe 28 during a milling operation. Additional extensions subs 10, as many as required, may be inserted in the well string above the milling shoe 28. Rotation of the extension subs 10 with the milling shoe 28 then tends to mill the metal parts, rock of other material in the bore of the extension sub 10, and allow further penetration of the milling shoe 28 to release the tool that is stuck in the hole. Once the fish is released, it may be removed from the hole.

Immaterial modifications may be made to the embodiments of the invention described here without departing from the invention.

What is claimed is:

1. An extension sub for a downhole fishing tool, the extension sub comprising:

a tubular having a threaded pin end and a threaded box end;

the tubular having an interior wall defining a straight bore; and cutting elements fixed to the interior wall of the tubular in a position extending into the bore of the tubular, in which the cutting elements are welded into slots in the interior wall of the tubular or welded onto the interior wall of the tubular.

2. The extension sub of claim 1 in which the cutting elements comprise buttons.

3. The extension sub of claim 2 in which the cutting elements comprise rows of buttons.

4. The extension sub of claim 3 in which the rows are slanted.

5. The extension sub of claim 1 in which the cutting elements are welded into slots in the interior wall of the tubular.

6. The extension sub of claim 1 in which the cutting elements are welded onto the interior wall of the tubular.

7. The extension sub of claim 1 used in a fishing operation.

8. An extension sub for a downhole fishing tool, the extension sub comprising:

a tubular having a threaded pin end and a threaded box end;

the tubular having an interior wall defining a bore; and button cutting elements fixed to the interior wall of the tubular and extending into the bore of the tubular, in which the button cutting elements are welded into slots in the interior wall of the tubular or welded onto the interior wall of the tubular.

9. The extension sub of claim 8 in which the button cutting elements are arranged in rows.

10. The extension sub of claim 9 in which the rows are slanted.

11. The extension sub of claim 8 in which the button cutting elements are welded into slots in the interior wall of the tubular.

12. The extension sub of claim 8 in which the button cutting elements are welded onto the interior wall of the tubular.

13. A well string, comprising:

tubulars forming a well string, the well string having a lower end;

a milling shoe at the lower end of the well string; and plural extension subs above the milling shoe, each extension sub having an interior wall defining a bore, and cutting elements fixed to the interior wall and extending into the bore, in which the cutting elements are welded into slots in the interior wall of the tubular or welded onto the interior wall of the tubular.

14. A method of fishing for a stuck or broken fish in a well, where the stuck or broken fish includes broken off coil tubing, the method comprising the steps of:

lowering a well string into the well with the well string terminated with a milling shoe and extension sub above the milling shoe, where the extension sub has an interior wall defining a bore, and cutting elements fixed to the interior wall and extending into the bore, in which the cutting elements are welded into slots in the interior wall of the tubular or welded onto the interior wall of the tubular;

milling the fish with the milling shoe;

while milling the fish with the milling shoe, milling the broken off coil tubing with the extension sub; and removing the fish from the well.

15. The method of claim 14 in which the well string is terminated with plural extension subs and each extension sub of the plural extension subs has an interior wall defining a bore, and cutting elements fixed to the interior wall and extending into the bore.

16. The method of claim 15 in which the cutting elements are fixed in position extending into the well bore.

17. The method of claim 16 in which the cutting elements comprise buttons.

* * * * *